United States Patent [19]

Kato et al.

[11] Patent Number: 5,011,202

[45] Date of Patent: Apr. 30, 1991

[54] HANDLE ASSEMBLY FOR USE WITH DOOR LOCKING DEVICE

[75] Inventors: Yuichi Kato; Masazumi Miyagawa, both of Yokohama, Japan

[73] Assignee: Ohi Seisakusho Co., Ltd., Yokohama, Japan

[21] Appl. No.: 320,060

[22] Filed: Mar. 7, 1989

[30] Foreign Application Priority Data

Mar. 24, 1988 [JP] Japan ..... 63-37686[U]

[51] Int. Cl.[5] ..... E05B 5/00

[52] U.S. Cl. ..... 292/336.3; 292/DIG. 31

[58] Field of Search ..... 292/336.3, DIG. 31, 292/DIG. 38, DIG. 23, 113, 247, 347; 16/110 R, 112, 115, 126

[56] References Cited

U.S. PATENT DOCUMENTS

| | | | |
|---|---|---|---|
| 3,795,416 | 3/1974 | Hehl et al. | 292/336.3 |
| 4,038,718 | 10/1977 | Reilhac et al. | 292/DIG. 31 X |
| 4,343,501 | 8/1982 | Meeks | 292/DIG. 31 X |
| 4,497,514 | 2/1985 | Moriya et al. | 292/DIG. 38 X |
| 4,580,822 | 4/1986 | Fukumoto | 292/DIG. 38 X |
| 4,634,161 | 1/1987 | Fukasawa et al. | 292/DIG. 38 X |
| 4,681,357 | 7/1987 | Uemura et al. | 292/DIG. 31 X |
| 4,778,207 | 10/1988 | Gergof | 292/DIG. 38 X |
| 4,818,003 | 4/1989 | Seko et al. | 292/DIG. 38 X |
| 4,838,590 | 6/1989 | Isomura | 292/DIG. 31 X |
| 4,858,973 | 8/1987 | Ogasawara et al. | 292/DIG. 31 |

FOREIGN PATENT DOCUMENTS

| | | | |
|---|---|---|---|
| 3311992 | 10/1984 | Fed. Rep. of Germany | 292/336.3 |
| 59-47062 | 3/1984 | Japan . | |
| 62-69558 | 5/1987 | Japan . | |

*Primary Examiner*—Eric K. Nicholson

*Attorney, Agent, or Firm*—Foley & Lardner

[57] ABSTRACT

An improved handle structure which comprises a body having a recess formed therein; a handle proper shaped like a rectangular frame and including a first U-shaped part and a second U-shaped part which are connected at their foot portions to form the frame-like structure, the second U-shaped part being inclined relative to the first U-shaped part, the handle proper being pivotally held by the body having the first U-shaped part exposed to the outside of the body and the second U-shaped part put in the recess of the body; a knob pivotally received in the frame-like handle proper; and a coil spring for biasing the handle proper in such a direction as to draw the first U-shaped part toward a bottom of the recess of the body.

16 Claims, 2 Drawing Sheets

HANDLE ASSEMBLY FOR USE WITH DOOR LOCKING DEVICE

BACKGROUND OF THE INVENTION

1. Field of the Invention

The present invention relates in general to handle assemblies for use with door locking devices, and more particularly, to handle assemblies of a type which is particularly used as an inside handle for a hinged door of a motor vehicle.

2. Description of the Prior Art

Hitherto, various types of inside handle assemblies for a vehicular hinged door have been proposed and put into practical use. Some of them are shown in Japanese Utility Model First Provisional Publications Nos. 62-69558 and 59-47062.

However, the inside handle assemblies disclosed by such publications have the following drawbacks due to their inherent constructions.

That is, in the handle assembly of the former publication, it is difficult to make the same compact in size because of unavoidable usage of a bulky bezel structure in which a handle proper and a locking knob are installed.

In the assembly of the latter publication, marked play of parts used therein tends to occur because of unavoidable usage of a complicated arrangement of the parts. Furthermore, the complicated arrangement of the parts makes miniaturization of the handle assembly difficult.

SUMMARY OF THE INVENTION

It is therefore an object of the present invention to provide an improved handle assembly which is free of the above-mentioned drawbacks.

According to the present invention, there is provided a handle assembly for use with a door lock device, which is simple in construction, economical to manufacture and efficient in operation.

According to the present invention, there is provided an improved handle structure which comprises a body having a recess formed therein; a handle proper shaped like a rectangular frame and including a first U-shaped part and a second U-shaped part which are connected at their foot portions to form the frame-like structure, the second U-shaped part being inclined relative to the first U-shaped part, the handle proper being pivotally held by the body having the first U-shaped part exposed to the outside of the body and the second U-shaped part put in the recess of the body; a knob pivotally received in the frame-like handle proper; and biasing means for biasing the handle proper in such a direction as to draw the first U-shaped part toward a bottom of the recess of the body.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
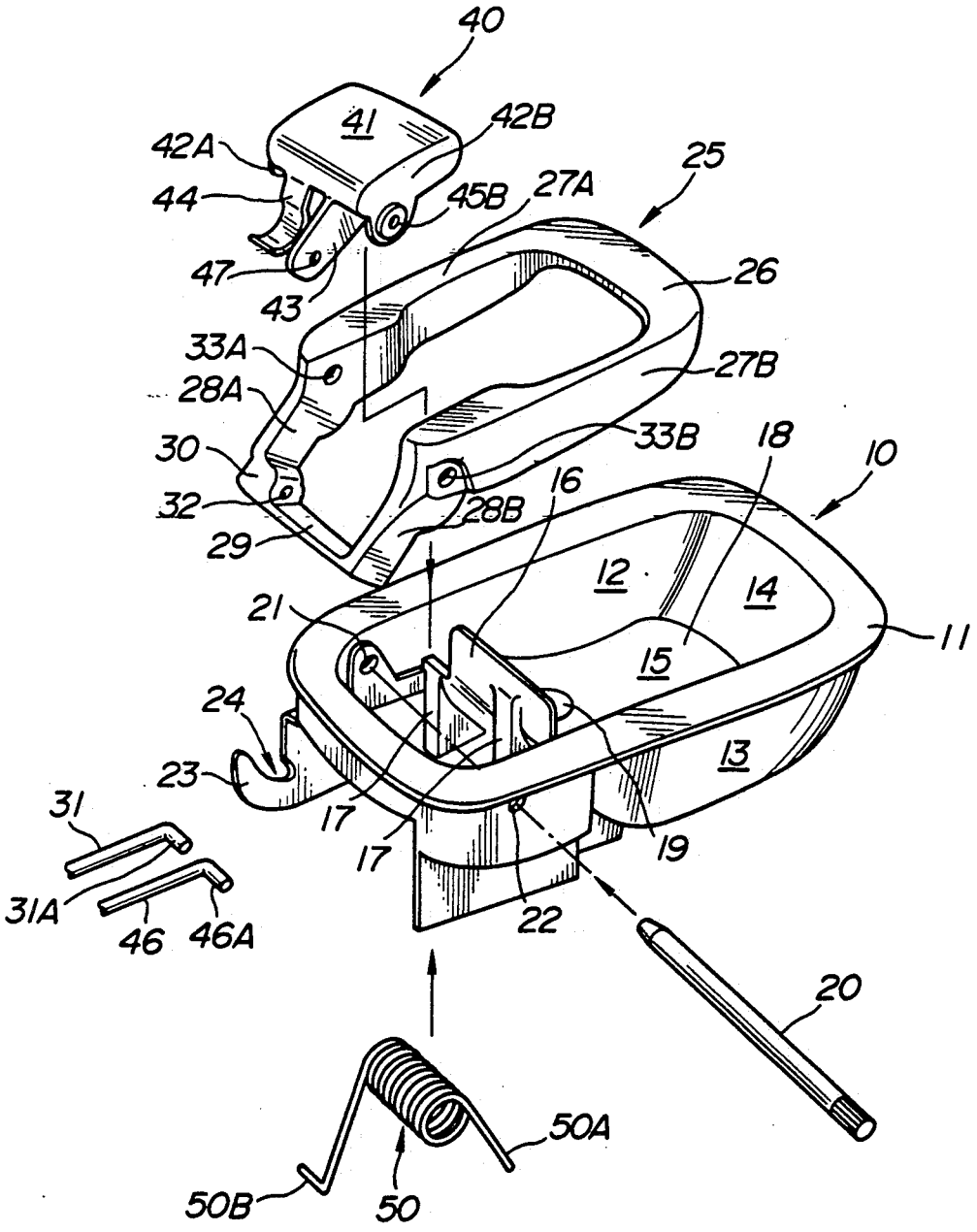
FIG. 1 is an exploded view of a handle assembly of the present invention.
Figure 2:
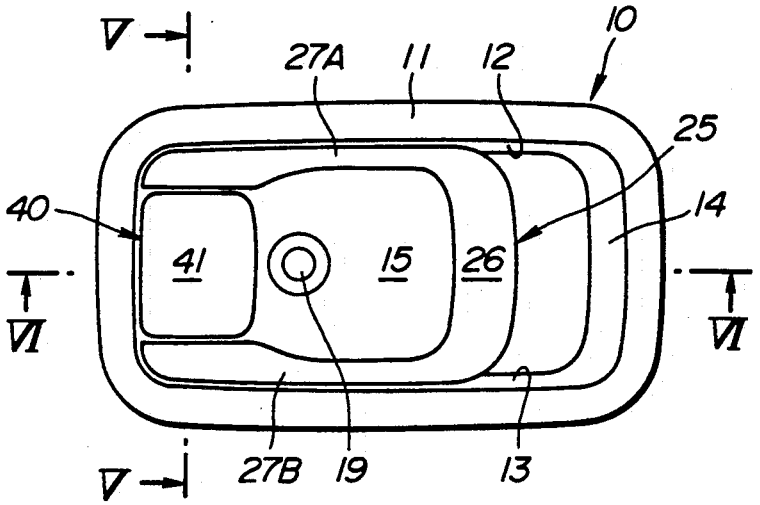
FIG. 2 is a plan view of the handle assembly.
Figure 3:
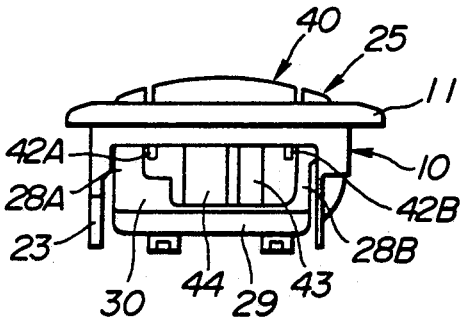
FIG. 3 is a side view of the handle assembly.

Referring to the accompanying drawings, particularly, FIG. 1, there is shown a handle assembly according to the present invention.

Generally designated by numeral 10 is a plastic recessed body which is shaped like a bathtub, as shown. The body 10 is formed with a flange 11 which extends along a peripheral edge of the mouth portion. That is, the body 10 comprises first, second and third side walls 12, 13 and 14 which have their upper ends integral with the flange 11, and a bottom wall 15 which has a periphery integral with lower ends of the side walls 12, 13 and 14.

Figure 4:
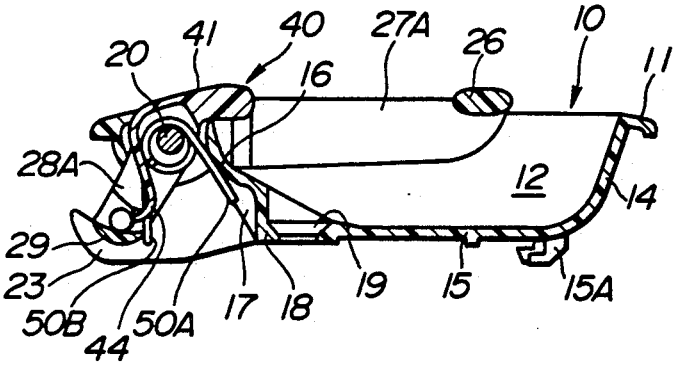
FIG. 4 is a sectional view taken along the line IV—IV of FIG. 2.
Figure 5:
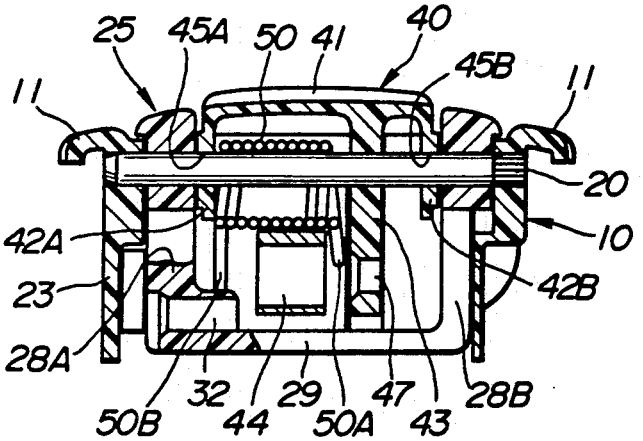
FIG. 5 is a sectional view taken along the line V—V of FIG. 2.

As will be understood from FIGS. 1 and 4, the bottom wall 15 has an aperture (no numeral) at its left side as viewed in the drawings. A vertical wall 16 is raised from the bottom wall 15 at a position near the aperture, that is, at a distance from the third side wall 14. The vertical wall 16 is reinforced by two ribs 17 which have roots merged with the bottom wall 15. The bottom wall 15 has near the ribs 17 a thicker part 18 (see FIG. 4) which has an opening 19 formed therethrough. Although not shown in the drawings, a bolt passing through the opening 19 is screwed into a mounting panel of a vehicular door for achieving tight connection of the body 10 to the door. As is seen from FIG. 4, the bottom wall 15 is formed at its outer surface with two hooks 15A which are to be engaged with positioning openings of the mounting panel upon mounting of the body 10 to the door.

The first and second side walls 12 and 13 are formed at the left portions as viewed in FIG. 1 with respective holes 21 and 22 through which a hinge pin 20 is to be passed in a manner as will be described hereinafter. As is seen from FIG. 1, the sections where the holes 21 and 22 are provided are reinforced by thicker portions of the side walls 12 and 13.

The body 10 is formed near the hole 21 with an outwardly extending holder portion 23 which has a recess 24 formed therein.

Designated by numeral 25 is an integral handle which is constructed of a plastic and pivotally held by the body 10 in such a manner as will be described hereinafter.

The handle 25 is shaped like a rectangular frame, which comprises a bar portion 26 which is to be handled by a finger or fingers of an operator upon manipulation of the handle, first and second side arm portions 27A and 27B which extend in parallel from axially opposed ends of the bar portion 26, first and second inclined leg portions 28A and 28B which extend from leading ends of the side arm portions 27A and 27B and a bridge portion 29 by which the leading ends of the leg portions 28A and 28B are connected. That is, the bar portion 26 and the first and second side arm portions constitute a first U-shaped part of the rectangular handle 25, while, the first and second inclined leg portions 28A and 28B and the bridge portion 29 constitute a second U-shaped part of the handle 25.

The inclined leg portion 28A or 28B and the corresponding arm portion 27A or 27B have an angle of about 135 degrees defined therebetween. The junction portion between the leg portion 28A or 28B and the corresponding arm portion 27A or 27B has a hole 33A or 33B through which the hinge pin 20 is to be passed.

At the junction section between the first leg portion 28A and the bridge portion 29, there is formed a thicker connecting portion 30 which has an opening 32 formed therethrough. Pivotally connected to the opening 32 is a hook portion 31A of a first operating member or rod 31 which extends from a door lock device (not shown) mounted in the door.

The vertical wall 16 of the body 10 is so arranged and sized that when the handle 25 assumes its rest position, the side edges of the vertical wall 16 are intimately put between the first and second arm portions 27A and 27B of the handle 25. Furthermore, the vertical wall 16 is formed with a shoulder portion (no numeral) against which lower surfaces of the first and second arm portions 27A and 27B abut when the handle 25 assumes the rest position.

Designated by numeral 40 is a locking knob constructed of a plastic, which comprises a rectangular upper face portion 41, first and second side wall portions 42A and 42B, a lug portion 43 and a curved tongue portion 44. The first and second side wall portions 42A and 42B are formed with aligned holes 45A and 45B through which the hinge pin 20 is to be passed. The lug portion 43 is formed at its leading end with an opening 47 to which a hook portion 46A of a second operating rod 46 extending from the door lock device (not shown) is pivotally connected.

Designated by numeral 50 is a coil spring used for biasing the handle 25 in a direction to be received in the body 10. Upon assembly, the coil spring 50 is disposed about the hinge pin 20 having one end 50A engaged with the back side of the vertical wall 16 and the other end 50B hooked to the thicker portion 30 of the handle 25.

In order to assemble the handle assembly, the following steps are taken.

First, the coil spring 50 is put on the curved tongue portion 44 of the locking knob 40 having their ends 50A and 50B directed downward. Then, the locking knob 40 with the coil spring 50 is put between the arm portions 27A and 27B of the handle 25. Thereafter, the handle 25 thus semiassembled is put into the body 10 and arranged in such a manner that the holes 45A and 45B of the locking knob 40 and the holes 33A and 33B of the handle 25 become aligned with the holes 21 and 22 of the body 10. Then, the hinge pin 20 is passed through the aligned holes.

In order to mount the handle assembly thus assembled to the door inside panel, the following steps are taken. (Before this mounting, the first and second operating rods 31 and 46 from the door lock device are properly mounted to the door inner panel.)

That is, the handle assembly is put into an aperture (not shown) of the door inside panel in such a manner that the flange 11 of the body 10 is seated on a peripheral portion of the aperture. Under this condition, the recess 24 of the holder portion 23 and the recess of the curved tongue portion 44 are deeply engaged with the hook portions 31A and 46A of the first and second operating rods 31 and 46, respectively. Then, the handle assembly is moved to a predetermined position. Thereafter, the hook portions 31A and 46A of the first and second operating rods 31 and 46 are brought into engagement with their corresponding openings 32 and 47 of the handle 25 and the locking knob 40. Because the first and second operating rods 31 and 46 are kept held stably by the holder portion 23 and the curved tongue portion 44 during the movement of the handle assembly to the predetermined position, the engagement of the hook portions 31A and 46A to the openings 32 and 47 is easily carried out. Thereafter, a bolt (not shown) is passed through the bolt opening 19 of the body 10 and screwed into a fixed member of the door inside panel.

With these steps, the handle assembly is tightly mounted to the door inside panel having the flange 11 intimately seated on the peripheral portion of the aperture of the panel.

In order to open the door, the handle 25 is pulled or pivoted about the hinge pin 20 against the force of the spring 50. With this, the first operating rod 31 is pulled and thus a latched condition of the door lock device is canceled. Thus, thereafter, the door is permitted to open when pushed outward.

In order to lock the latched condition of the door lock device, the locking knob 40 is pushed to turn about the hinge pin 20. With this, the second operating rod 46 is pushed toward the door lock device.

In the following, advantages of the present invention will described.

First, because of provision of the inclined leg portions 28A and 28B of the handle 25, the bridge portion 29 is neatly received within the recessed body 10. Thus, the size, more specifically, the length of the body 10 can be reduced by a degree corresponding to the width of the bridge portion. This will be understood when considering that in the handle assembly of the afore-mentioned Japanese Publication No. 62-69558; the bridge portion is exposed to the outside of the body placing the locking knob away from one edge of the mouth portion of the bezel structure.

Second, because the handle 25 is constructed to have a generally rectangular frame structure, the same can have a marked mechanical strength even when constructed of a plastic.

Third, since the locking knob 40 and the handle 25 are neatly and compactly received within the recessed body 10, the entire construction of the handle assembly can be miniaturized.

What is claimed is:

1. A handle structure comprising:

a body having a recess formed therein;

an integral handle proper comprising a bent rectangular frame and including a first U-shaped part and a second U-shaped part which is inclined relative to said first U-shaped part, each of said first and second U-shaped parts comprising two generally parallel legs and a cross portion, said cross portion of said second U-shaped part defining a bridge portion which includes a connecting part to which an operating member is connected;

means for pivotally connecting said frame of said handle proper in such a manner that said second U-shaped part is kept received in said recess of said body even when, due to a pivotal movement of said handle proper, said first U-shaped part is pivoted outside said body;

a knob received in and pivotally held by said frame of said handle proper; and biasing means for biasing said handle proper in such a direction as to draw said first U-shaped part toward a bottom wall of said recess of said body;

wherein pivotal connection between said handle proper and said body and pivotal connection between said knob and said handle proper are achieved through a common hinge pin which is pivotally supported by opposed side walls of said body;

wherein said hinge pin passes through aligned openings which are formed at a junction of said first U-shaped part and said second U-shaped part;

wherein said biasing means comprises a coil spring which is disposed about said hinge pin having one end engaged to said body and the other end engaged to said second U-shaped portion; and wherein said second U-shaped part is formed with a bored thicker portion which is thicker in cross section than the cross section of the rest of said second U-shaped part and to which a hook portion of a first operating rod is pivotally connected.

2. A handle assembly as claimed in claim 1, in which said knob is formed with a lug and said lug being formed with a hole to which a hook portion of a second operating rod is pivotally connected.

3. A handle assembly as claimed in claim 2, in which said recess of said body is formed at a bottom wall thereof with a vertical wall, said vertical wall being so arranged and sized that when said frame of said handle proper assumes a rest position, said vertical wall is received in an opening defined by said frame of said handle proper.

4. A handle assembly as claimed in claim 3, in which said vertical wall is formed with a shoulder portion to which given portions of said frame of said handle proper abut when said handle proper assumes said rest position.

5. A handle assembly as claimed in claim 4, in which said bottom wall of said recess of said body is formed with an aperture through which said second U-shaped part of the handle proper is exposed to the outside of said body.

6. A handle assembly as claimed in claim 1, in which said thicker portion is formed at a junction between one of said parallel legs and said bridge portion of said second U-shaped part.

7. A handle assembly as claimed in claim 6, in which said one end of said coil spring is engaged with said thicker portion of said second U-shaped portion.

8. A handle assembly as claimed in claim 2, in which said knob is formed with a curved tongue is generally rectangular and adjacent to said lug, said tongue guiding said hook portion of said second operating rod.

9. A handle assembly as claimed in claim 3, in which said vertical wall is raised from said bottom wall in a parallel manner to opposed end walls of said body.

10. A handle assembly as claimed in claim 9, in which said vertical wall is formed with shoulder portions on which said parallel legs of said first U-shaped part abut when said frame of said handle proper assumes said rest position.

11. A handle assembly as claimed in claim 10, in which said bottom wall of said recess of said body comprises an aperture between said vertical wall and one of said end walls through which said second U-shaped part of handle proper is exposed to the outside of said body.

12. A handle assembly as claimed in claim 11, in which said hinge pin for pivotally connecting said frame of said handle proper to said body is arranged above said aperture.

13. A handle assembly as claimed in claim 12, further comprising:

a holder portion extending outwardly from said aperture and parallel to one of said side walls of said body, said holder portion having a recess formed therein for holding said hook portion of said first operating rod during assembly.

14. A handle assembly as claimed in claim 13, wherein said coil spring disposed about said hinge pin is engaged with said one end to a back side of said vertical wall and said other end is engaged with said thicker portion of said second U-shaped part.

15. A handle assembly as claimed in claim 14, wherein said vertical wall is reinforced by two ribs which have roots merged with said bottom of wall.

16. A handle structure comprising:

a body having a recess formed therein;

an integral handle proper shaped like a bent rectangular frame and including a first U-shaped part and a second U-shaped part which is inclined relative to said first U-shaped part about 135 degrees, each of said first and second U-shaped parts comprising two generally parallel legs and a cross portion, said cross portion of said second U-shaped part defining a bridge portion which is formed at a junction with one of said parallel legs of said second U-shaped part with a bored portion thicker in cross section than the rest of said second U-shaped part;

a first operating rod having a hook portion inserted into said bored portion for pivotally connecting said operating rod with said frame of said handle proper;

a hinge pin passing through aligned openings formed at a junction of said first U-shaped part and said second U-shaped part pivotally connecting said frame of said handle proper with said body;

a knob received in said first U-shaped part of said frame and pivotally supported by said hinge pin, said knob comprising a lug projecting into said recess of said body and a generally rectangular curved tongue adjacent to said lug, said lug including an opening through which a hook portion of a second operating rod is pivotally connected, said hook portion being guided by said curved tongue;

said recess having a vertical wall raised from a bottom wall of said body parallel to opposed end walls of said body, said vertical wall being received by an opening formed by said frame of said handle proper when said handle proper assumes a rest position, wherein said parallel legs of said first U-shaped part abut on shoulder portions formed in said vertical wall when said handle proper assumes said rest position;

an aperture formed between said vertical wall and one of said end walls through which said second U-shaped part of the frame of said handle proper is exposed to the outside of said body, said hinge pin pivotally connecting said handle proper and said knob to said body above said aperture;

a holder portion extending outwardly from said aperture and parallel to one of said side walls of said body, said holder portion having a recess formed therein for holding said hook portion of said first operating rod during assembly; and a coil spring disposed about said hinge pin and having one end engaged with said vertical wall and the other end engaged with said thicker portion of said second U-shaped part of said frame of said handle proper for biasing said handle proper in such a direction as to draw said first U-shaped part toward said bottom wall of said recess of said body.

* * * * *